US006938898B2

(12) United States Patent
Merritt, III

(10) Patent No.: US 6,938,898 B2
(45) Date of Patent: Sep. 6, 2005

(54) COMBINATION ROLE PLAYING AND DICE THROWING BOARD GAME

(76) Inventor: Gilbert S. Merritt, III, 14 Oxford St., Rochester, NY (US) 14607

( * ) Notice: Subject to any disclaimer, the term of this patent is extended or adjusted under 35 U.S.C. 154(b) by 0 days.

(21) Appl. No.: 10/364,850

(22) Filed: Feb. 11, 2003

(65) Prior Publication Data

US 2004/0046319 A1 Mar. 11, 2004

Related U.S. Application Data

(60) Provisional application No. 60/408,442, filed on Sep. 5, 2002.

(51) Int. Cl.[7] ..... A63F 3/00
(52) U.S. Cl. ..... 273/236; 273/255; 273/262
(58) Field of Search ..... 273/236, 255, 273/262, 276, 288, 292, 243, 290

(56) References Cited

U.S. PATENT DOCUMENTS 4,120,503 A * 10/1978 Macrory et al. ..... 273/244
4,570,938 A 2/1986 Ferris et al.
4,950,912 A * 8/1990 Goldfarb et al. ..... 273/249
5,476,264 A 12/1995 Ortega
5,895,046 A * 4/1999 Lee ..... 273/288
5,954,332 A * 9/1999 Mero et al. ..... 273/236
6,581,932 B2 * 6/2003 Jacobs ..... 273/236
6,585,265 B2 * 7/2003 Dewa et al. ..... 273/243

* cited by examiner

*Primary Examiner*—Vishu K. Mendiratta
(74) *Attorney, Agent, or Firm*—McKay & Associates, P.C.

(57) ABSTRACT

A combination role playing and board game comprising a plurality of action figures configured with detachable arm and head members, and which are moved within a grid-like board surface that represents an arena, wherein confrontations and other events are simulated. Multiple types of dice are used to direct the locations of the action figures and the type of event that may occur upon confrontation with an opposing figure. Each action figure is capable of being disassembled as a result of such confrontation and has certain confrontational qualities which lend themselves to enhanced types of attacks and resistances thereof. Playing cards are used to represent the "health" of each game character, and a plurality of other game cards and chips may be placed on the grid board to represent traps and other devices.

17 Claims, 5 Drawing Sheets

COMBINATION ROLE PLAYING AND DICE THROWING BOARD GAME

SPECIFIC REFERENCE

The present application hereby claims benefit of priority date so established by provisional application Ser. No. 60/408,442, filed Sep. 5, 2002.

FIELD OF THE INVENTION

The invention relates to a board game with configurable action figures, and more particularly it relates to a role playing board game wherein the particular action figures are adapted to engage in combat with one another. The action figures are also configured to indicate the current state of health of the player. The object of the game is to inflict as much damage as possible on another player's action figure without compromising ones own action figure's health.

BACKGROUND OF THE INVENTION

The various types of board games provide players with challenging, intellectually stimulating, and even educational experiences. Some board games allow players to assume role playing positions during play. This role playing encourages players to have a more personally focused role within the game and be more involved in the game activities, compared to merely playing the game as a presumed third person.

Various role playing board games are known in the art. U.S. Pat. No. 5,476,264 discloses a quest and battle board game where players, through their game pieces, navigate the board in search of specific weapons. The players then use the newly acquired weapons during battle with the enemy in the final phase of the game. The game is played on a rectangular game board, which has a battle side and a world map side. The world map side of the game board is used for the "quest" phase of the game and the "battle" side is used for the combat aspect of the game.

U.S. Pat. No. 5,954,332 discloses a board game wherein a plurality of players are split up into various classes. The players compete within each class to determine a class winner. The class winners compete with each other until only two players remain. The final two players then unite to play against a final opponent. This invention utilizes more than two game boards throughout the game.

U.S. Pat. No. 4,570,938 discloses a board game played on a grid-like board. Some game pieces described in this invention are capable of knocking over other game pieces during play.

None of these inventions disclose game pieces or action figures used in a role playing board game that are configurable with detachable limb and head pieces for visually indicating certain health and physical characteristics of the action figures. These inventions also do not disclose action figure information cards, which provide data regarding the particular strengths and weaknesses of each figure, and which data can be visually indicated by the action figure because the action figures are capable of being disassembled to represent the effects of battle resulting from rolls of dice.

SUMMARY OF THE INVENTION

A combination role playing and dice throwing board game comprising a plurality of action figures is disclosed. These figures are moved within a rectangular grid-like game board surface, which represents a battle arena, wherein combat situations and other events are simulated. The game board is divided into a plurality of congruent sections. Multiple types of dice, with variably numbered sides, are used to direct the locations and movement of the action figures and the type of event that may occur upon confrontation with an opposing action figure. Each action figure is capable of being partially disassembled at the arms and the head as a result of confrontation during the game. In addition, the action figures include an information card, which describes certain qualities that lend themselves to enhanced types of attacks and resistances thereof. Information cards include bloodcount point charts, which are used to represent the current health status of each action figure. A plurality of other game cards and chips may be placed on the grid board to represent traps, accessible weapons, and other indicia used in the game.

Particularly, what is provided is a combination role playing and dice throwing board game comprising a planar, rectangular grid-like game board including a plurality of congruent sections. Also included are two or more action figures, wherein the action figures are configured with detachable arm and head members, and a plurality of dice. One of the dice includes event information corresponding to some of the game cards. Further, two or more action figure information cards are provided wherein the action figure information cards include a plurality of abilities of the action figures. The action figures comprise rod members integrally attached to and extending outwardly from the arm and head members. The action figure information cards include bloodcount point charts, wherein two or more tokens are placed upon the bloodcount point charts to track the health of the action figures.

One object of the present invention is to allow players to become involved in the game through role playing and configurable action figures.

Another object of the present invention is to simulate actual combat among the action figures during play.

Other objects, advantages and details of the present invention will be described in full detail below.

DETAILED DESCRIPTION OF THE DRAWINGS

Figure 1:
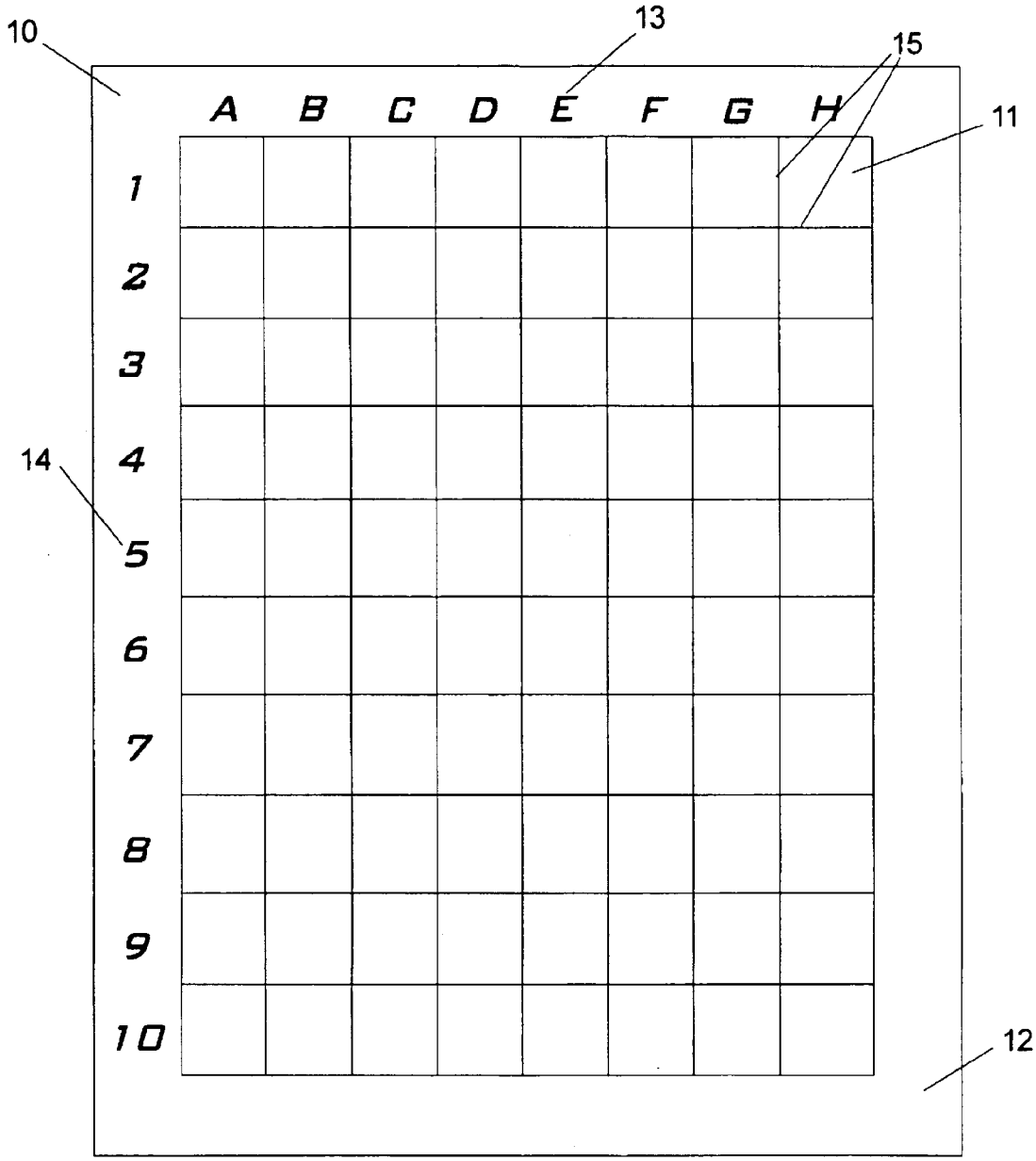
FIG. 1 is an overhead view of the grid-like game board used as the playing surface.

With reference then to FIGS. 1–7, the game board 10 is comprised of a flat grid-like surface, preferably divided up into a plurality of congruent sections 11. These sections 11 are preferably square or rectangular, with section-borders 15 either slightly raised or flush with the grid-like surface. The game board 10 may have any number of sections 11 as long as it maintains a square or rectangular shape overall. Optimally, the game board 10 will be eight sections 11 wide and ten sections 11 in length, though the dimensions may obviously vary. This game board 10 may have various markings on it, mainly for effect. It may be made out of plastic, cardboard, plywood, paper or any other similar material.

Now referring to FIG. 4, numerous dice are used in the game. Two dice, known as the location dice (FIGS. 4*c*, 4*e*) correspond to the number of rows and columns on the game board 10. For example, the first location die (FIG. 4*e*) may be lettered A–H to represent each column of the board 10. The second location die (FIG. 4*c*) would then be numbered 1–10 to represent the rows of the board 10. The game board 10 has these column 13 and row 14 location markers on its perimeter 12. It is not important that the columns are represented by letters and the rows are represented by numbers, any means of correlation between the location dice (FIG. 4*e*, 4*c*) and positioning on the grid-like game board 10 will suffice.

The player rolls the location dice (FIGS. 4*c*, 4*e*) to determine where an action figure 20, event card 71, or other game piece should be placed on the game board 10. The location dice (FIGS. 4*c*, 4*e*) can also be used when an action figure 20 loses a pool of blood 72, represented by a game piece, so that the pool of blood 72 may be placed upon the game board 10. The pool of blood may be a plastic, molded game piece or it may be represented by a game card. If the location dice (FIGS. 4*c*, 4*e*) are numbered they can be utilized in other aspects of the game described below.

The game also includes a six (FIG. 4*d*), eight (FIG. 4*b*), and twelve-sided (FIG. 4*a*) die. These dice and the 10-sided die (FIG. 4*c*) are used throughout the course of the game. Mainly, the number of rolls of a certain die a player is awarded on each turn is determined by that player's action figure's information card 50. For example, if a player's figure information card 50 represents that a particular action gives that action figure 20 "3d12", the player rolls the twelve sided die (FIG. 4*a*) three times. If the information card 50 provides "5d8" for an action figure 20, the player rolls the eight sided die (FIG. 4*b*) five times. These dice are used in every attack, defense and many other aspects of the game as will be further described.

Figure 4A:
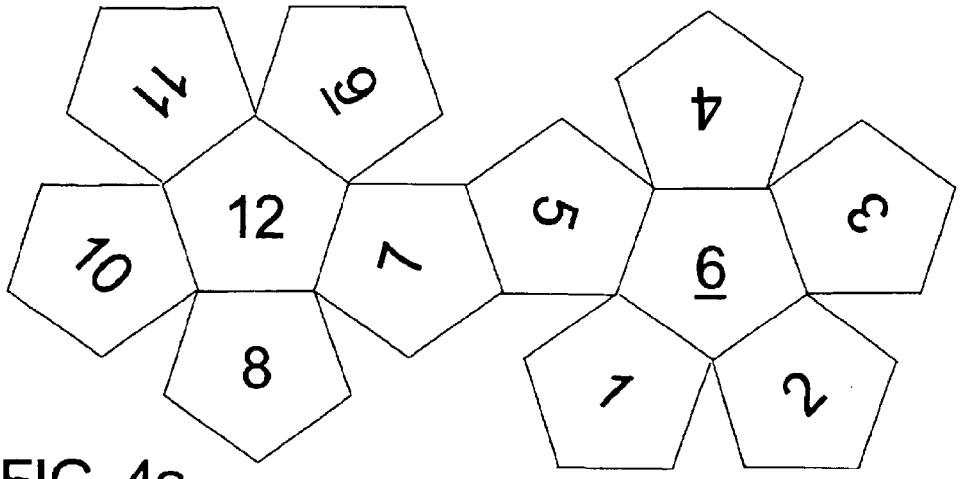
FIG. 4*a* is an expanded view of the 12-sided die.
Figure 4B:
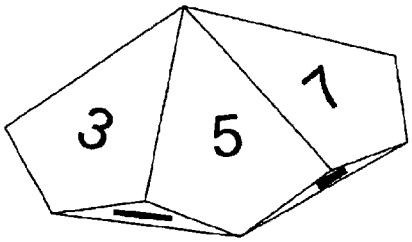
FIG. 4*b* is a perspective view of the 8-sided die.
Figure 4C:
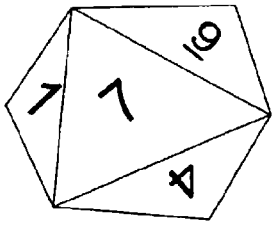
FIG. 4*c* is a perspective view of the 10-sided die, also known as one of the location dice.
Figure 4D:
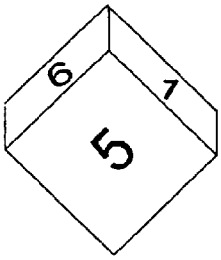
FIG. 4*d* is a perspective view of the 6-sided die.
Figure 4E:
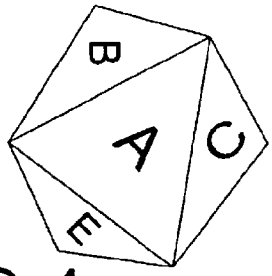
FIG. 4*e* is a perspective view of one of the location dice.
Figure 4F:
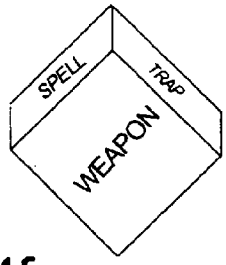
FIG. 4*f* is a perspective view of the event die.
Figure 5:
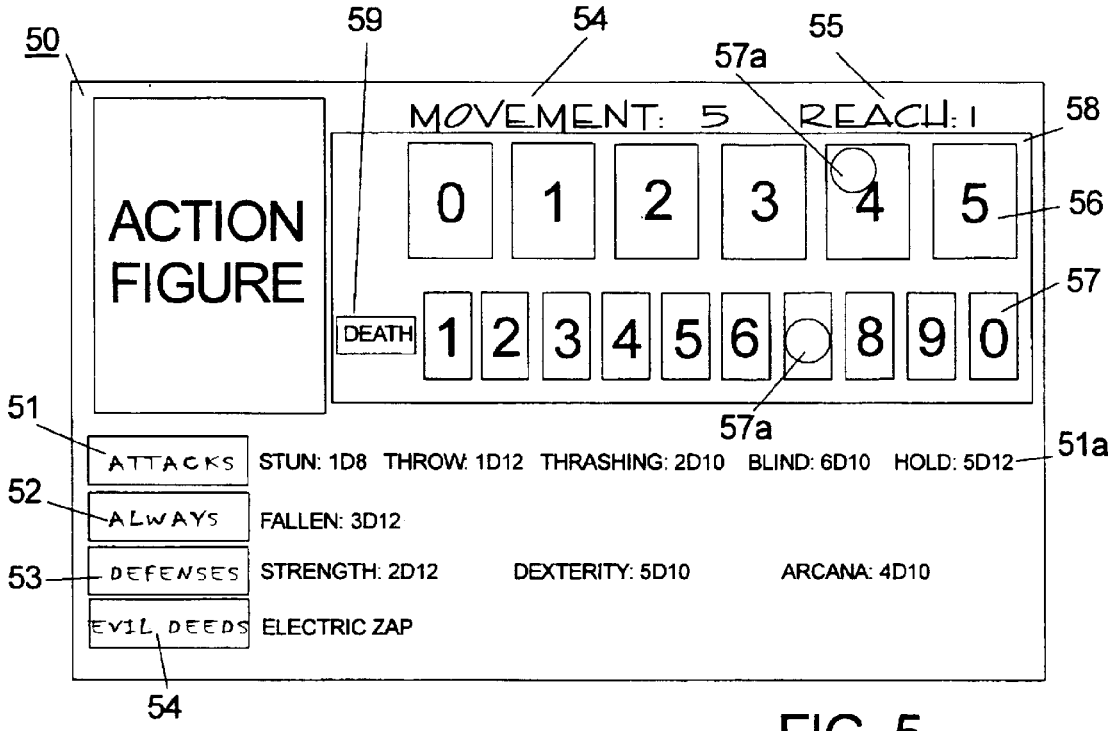
FIG. 5 is a front view of an example action figure information card.
Figure 6:
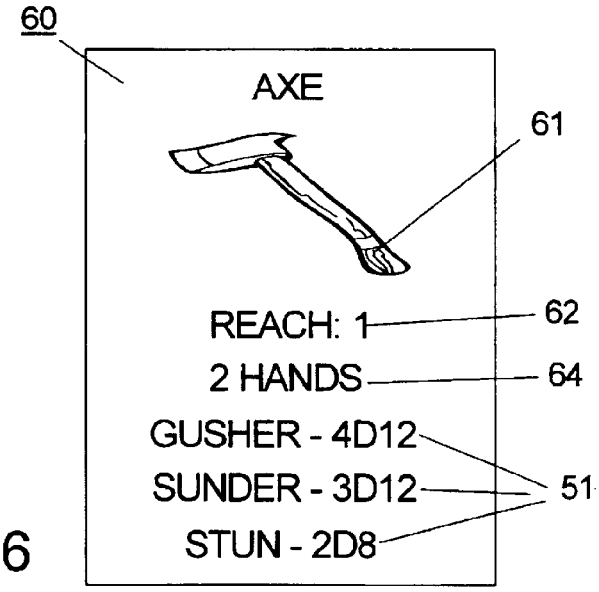
FIG. 6 is a front view of an example weapons card.

Yet another die used in the game is called the event die (FIG. 4*f*). At the beginning of each player's turn, that player rolls the event die (FIG. 4*f*), to determine an event that will occur on the game board 10. This event die (FIG. 4*f*) can be six to eight-sided. Some events may appear more than once on the die, or some sides of the event die (FIG. 4*f*) may be blank, which would result in the absence of any event, or the player may re-roll if necessary. Each side of the event die (FIG. 4*f*) represents a particular event, which will occur on the game board 10. The preferred events that usually occur are weapon, spell, trap, and disease. Each event represented on the event die (FIG. 4*f*) corresponds to some (approximately half) of the game cards known as the event cards 71. For example, if a player rolls "weapon" on the event die (FIG. 4*f*), that player will select an event card 71 from a pile of weapon event cards to determine which weapon will be placed upon the game board 10. See FIG. 6 for an example of a weapon event card 60.

The event card 71, which could represent a disease, spell, trap or a weapon, is placed on the game board 10 by rolling the location dice (FIGS. 4*c*, 4*e*). If an event card 71 is placed on the same section 11 as an action figure 20 that action figure 20 can claim it, or it may be required to claim it. A weapon event card 60 displays a particular weapon and is placed face up on the game board 10. The spell event card represents a certain spell that may be used on the action figure 20 that lands on the section 11 of the game board 10 whereon the card is placed. The spell event card is preferably placed face down on the game board. This card can require the spell to be cast immediately, and therefore, it can be cast on any action figure 20 landing on that section 11. The trap event card is placed on the game board 10 face up and represents a destructive trap. If the trap card is placed on a section 11 where an action figure 20 is currently present, that action figure 20 will suffer the consequences of the trap. The disease event card is placed face down on a section 11 of the game board 10, and any player concurrently on that section 11 will obtain the disease represented on the card.

Figure 2:
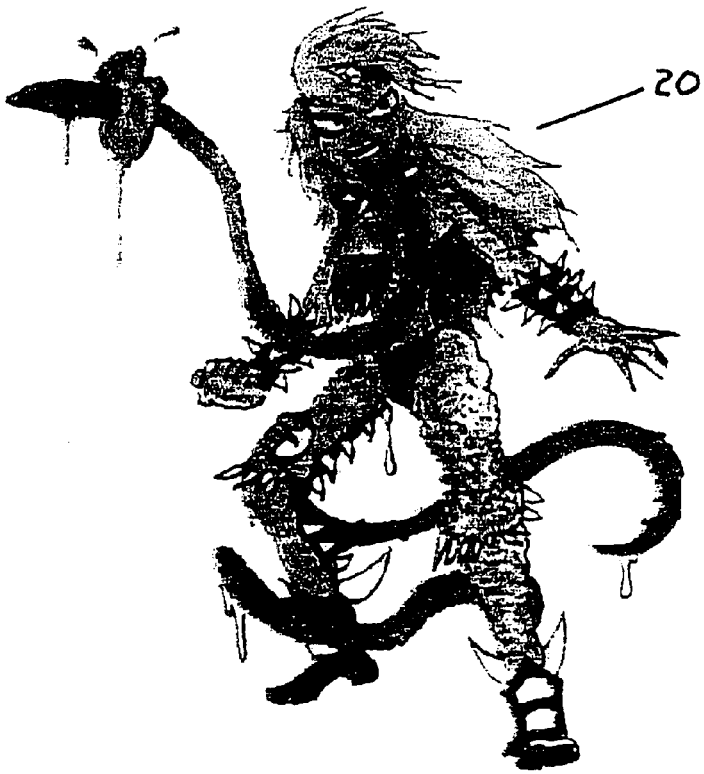
FIG. 2 shows a front view of an example of an action figure.
Figure 3:
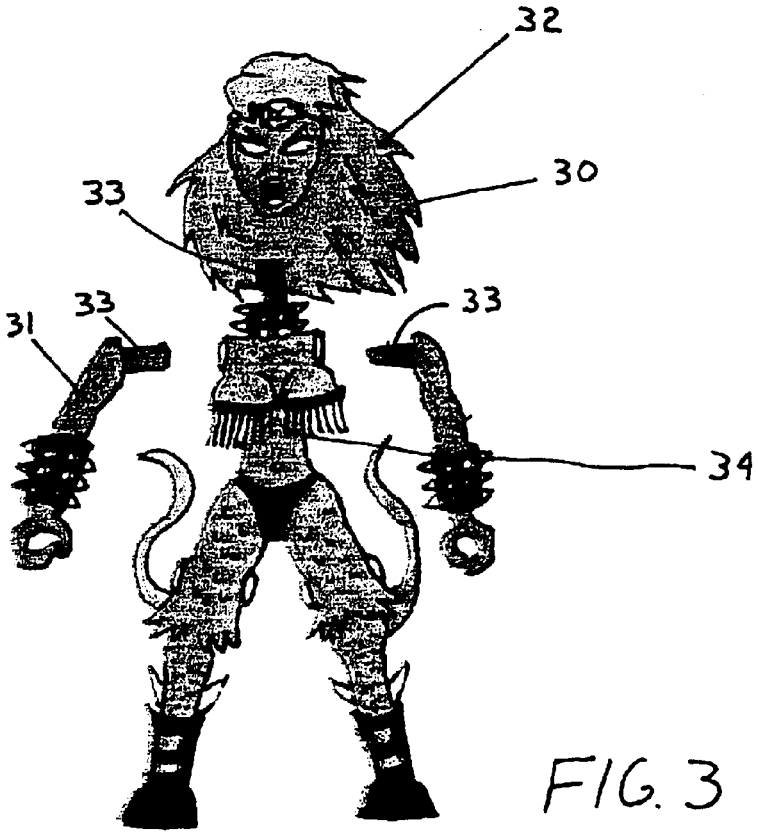
FIG. 3 is a front view of an action figure disassembled at the head and arms.

Each action figure 20 has a different physical configuration. An example action figure 20 configuration is displayed in FIG. 2. The shown configuration in FIG. 2 is merely an example of an action figure 20 and many different action figures 20 will be provided in the game. Each figure's arms 31 and head 32 comprise rod members 33 protruding therefrom for connection to the main body 34 of an action figure 20. These rod members 33 slide into holes (not shown) in the shoulder and neck areas of the action figures. Preferably they do not snap into place, rather each rod member 33 is held in place within the shoulder and neck areas by friction and is similar in size and shape to enable attachment to any action figure 20 during the game. In a further embodiment, the hand portions 33*a* of each action figure are configured to hold miniature plastic weapons, which weapons are represented using weapons cards as will be further described. It is important to be able to exchange and remove the arms 31 and head 32 of an action figure 20 during play because these parts may be "severed" from the action figures 20 during simulated combat. An action figure 20 could lose both arms 31 during combat, which would limit the attack moves 51 of that particular figure 20, especially if that action figure were to be carrying a weapon. Thus, the action figures 20 not only serve as a game piece but also a physical representation of the health status and attack abilities of each warrior.

An information card 50 containing figure statistics accompanies each action figure 20. This figure information card 50 may include statistics regarding movement 54, reach 55, a bloodcount point chart 58, health status during play, attack moves 51, always moves 52, which a player can use regardless of what physical state his action figure 20 is in, and defenses 53. It also provides the number of rolls of the die a player will have in a certain situation, and of which die the player may roll.

These defense attributes 53 represent physical or mental characteristics of that action figure 20. The preferred embodiment includes the characteristics of strength, dexterity, and arcana. Strength represents the figure's physical fighting power, and is represented by the color red. Dexterity is a measure of the agility and gymnastic abilities and is represented in blue. A successful defense 53 against a dexterity-based attack move 51 allows an immediate movement of the defending action figure 20, one space per countering hit scored. Arcana signifies the figure's prowess with magic, forbidden lore, and the dark arts and is represented in purple. These three defensive features 53 are represented on an opposing figure's information card 50 by color-coding the attack moves 51. For example, an attack move 51 printed in red font will focus on the strength of the opponent. Therefore, the opponent will use his strength defense of "2D12", for example, to counter the attack. An attack move 51 printed in blue font will focus on the dexterity of an opponent, and the opponent will counter with his or her dexterity defensive roll. Finally, a purple attack move will focus on the arcana of an opponent and the opponent will counter with his or her arcana defensive roll.

The bloodcount of each action figure 20 is a further aspect of this game. Bloodcount represents the health of a player during play. If a figure's bloodcount falls to zero that player loses the game, through simulated death 59. A dead action figure 20, remains on the game board 10, in the section 11 where it was killed. Each action figure 20 starts with 60 points of bloodcount, which normally is not exceeded during play. Each time an action figure 20 loses a battle to another figure 20 or an injury is inflicted, that figure 20 loses bloodcount points (and potentially, an arm or head). Bloodcount points are not kept secret during play. Bloodcount points can be lost in increments of one, five and ten. A one-point loss in bloodcount is known as a "drip", a five-point loss a "splat", and a ten-point loss a "pool" 72.

A player must roll a nine, ten, eleven or twelve to inflict a "drip" of bloodcount loss. A "splat" of bloodcount loss is accomplished by rolling a seven or an eight. To inflict the most bloodcount loss allowed, or a "pool" 72 loss, to an opponent, the player must roll a six. Each infliction of bloodcount loss is termed a hit. A six is counted as two hits during combat. Rolling a 1–5 accomplishes nothing for the attacking figure. For example, if a player's information card provides "4d10" for a certain attack and the player rolls an eight, a six, a two and a ten, the player has scored four hits. The total bloodcount loss accomplished by the four hits would be one "drip" for the ten, and one "splat" for the eight and one "pool" 72 for the six. The opposing figure in this particular scenerio would lose a total of 16 bloodcount points. This example assumes that the defending player was not able to block any of the hits.

Action figures 20 are able to defend against attacks 51 by means of defensive rolling or hit blocking. The number of rolls and of which die a defending player uses is determined by the attack means's color-coding. For example, if the attack 51 means is in red font, the defending player will refer to his information card's defense 53 of strength, since strength is represented in red, for rolling instructions. The instructions could be for example "2D12". If being attacked by more than one opposing action figure 20 at the same time, action figures 20 are allowed to defend against each attack 51.

Blocking hits is similar to inflicting hits. Rolling a 1–5 accomplishes nothing. If a defending player rolls a 7 or above one hit is blocked. Since a six rolled by an attacker delivers two hits, a defending player must roll a 6, or use two counter hits 7–12 to offset the attacker's 6. Therefore, if a defending player rolls a 6, it counts as two counting hits. The hits that will cause the most amount of bloodcount point loss will be cancelled first.

EXAMPLE

The attacking player rolls a 6, 8, and a 10 for a total of four hits. The defending player rolls a 5, 8, 11 and 9 for a total of three counter hits. Since the defending player needs two hits to cancel out the attacking 6, two countering hits are used here. The third countering hit blocks the attacker's 8, because the attacking hits that inflict the most damage are cancelled first. The attacker's 10 will hit the defender causing 1 point of bloodcount loss on this attack.

EXAMPLE

The attacking player rolls a 7, 8, 10 and 6, for a total of five hits. The defending player rolls a 3, 5, 6 and 8 for a total of three counter hits. The sixes rolled by each player here nullify each other since they each count for two hits. The defending player's 8 cancels the attacking player's 7. The attacker's 8 and 10 will hit the defending player for a total of a 6 bloodcount point loss. (The 8, a "splat", inflicts 5 points of bloodcount loss, and the 10, a "drip", inflicts 1 point of bloodcount loss.)

If the defending player scores no counter hits, the attacking player is given what is termed a combo attack. Here, the attacker may perform an evil deed 54 from his action figure information card 50. Generally, evil deeds 54 are more gruesome attacks that results in massive bloodcount point loss. An evil deed 54 can occur only when an opponent's bloodcount points fall below a certain level. Evil deeds 54 are coded in green, yellow and red corresponding to health status of figures. For example, an evil deed 54 coded in red would only be available against a player with bloodcount points in the red phase.

Bloodcount points are recorded by a bloodcount chart 58 on the action figure's information card 50. This chart 58, shown in FIG. 5, includes two rows of numbers 56, 57. The top row 56 represents 10 bloodcount points, while the bottom row 57 represents a single bloodcount point. Players place tokens 57*a* on the appropriate numbers to track bloodcount points and therefore health during play. For example, if an action figure 20 had forty-seven bloodcount points left during a game, the player would place a token on the 4 in the top row 56, and the 7 in the bottom row 57 (see FIG. 5).

Each figures movement scores 54 and reach scores 55 are also displayed on the information card 50. Reach 55 is defined as the maximum number of sections 11 on the grid-like game board 10 wherein a player can initiate an attack move 51. The reach score 55 ranges from the same section 11 to three sections 11 away. If the reach score 55 is "same" the action figure 20 must be in the same section 11 as the opposing action figure 20 to attack. The movement score 54 can range from one to five. Usually, a player does not have to move his action figure 20 the total amount of spaces allowed by the movement score 54. If the player so elects, no action figure 20 movement is required. Further, an action figure 20 can move horizontally, vertically, or diagonally across the board. Action figures 20 can make turns up to 90 degrees, and can end a turn facing any direction they so choose. Preferably, no action figure 20 can back track between two sections 11 in a single turn.

As mentioned above, an action figure's 20 health is measured by bloodcount points. For example, a healthy action figure will have almost full bloodcount points. The bloodcount chart 58 is color coded to represent health status of the action figure. Full or nearly full health is represented by the color green. Mid levels of health are represented in yellow and faltering health levels are coded in red. The bloodcount point chart 58 would be color-coded red, then yellow and then green, from left to right. Some action figures 20 start out with mid-level or yellow health, even with full bloodcount points of sixty. In this situation, the bloodcount point chart 58 would be color-coded red then yellow, from left to right. The health status of an action figure 20 alerts other players to failing health of a certain action figure 20, which they may decide to attack.

During confrontations players will roll the die corresponding to the type of attack moves 51 they intend to execute. They can only use attack moves 51 that appear on their action figure's information card 50. Each attack move 51 is color-coded according to strength, dexterity, and arcana, and has an indication of how many rolls of a certain die a player is allowed. The color-coding of the attack moves 51 informs the player which characteristic of another action figure 20 the attack 51 will target. For example, an attack 51 in a red font would target the opposing figure's strength. The information card 50 also includes a roll indication 51*a* for each attack move 51. The roll indication 51*a* would appear, for example, as "3d12", which means the player would roll the 12-sided die three times during the attack 51.

Many different types of attack moves 51 can be used during play. A list of commonly used attack moves 51 can be seen in the chart below.

| Attack Move 51 | Definition | Result of Attack |
|---|---|---|
| Fallen | Pushing or wrestling another figure to the ground | Fallen figure must spend one action rising from the ground |
| Hold | Grasping another figure's arms and keeping them defenseless | Held figure cannot defend itself or execute any action, and can also be stunned |
| Thrashing | Punching and beating another figure with the arms | Figure may be subject to a combination attack |
| Throw | Tossing another figure across the board, at least two spaces | Always results in the thrown figure being fallen and must use a turn to get up |
| Blind | Hitting another figure in the eyes, causing temporary blindness | Blinded figure must make full movement on the next turn in a random direction, blindness lasts two turns |
| Burn | Burning another figure with a spell or weapon | Burn damage is permanent throughout the game, bloodcount cannot be fully restored to 60 |
| Immolate | Inflicting continuous burning upon another figure using a spell or weapon | Figure must make full movement in random directions, and suffers bloodcount loss on each turn |
| Gusher | Sundering of another figure's limb or head | Bloodcount loss until another arm or head is picked up from the board |
| Disease | Inflicting disease upon another figure | Inflicted figure has disease until it is cured, or passed to another figure, also suffers bloodcount loss |
| Impale | Gouging another figure with a sword or skewer | Impaled Figure is defenseless and suffers bloodcount loss |
| Poison | Injecting poison into another figure | Poisoned Figure suffers bloodcount loss only when he attacks others |
| Stab | Pierces another figure with a sharp object | Movement is one section less then portrayed on action figure's information card |

-continued

| Attack Move 51 | Definition | Result of Attack |
|---|---|---|
| Stun | Hitting another figure so hard, it leaves that figure in a state of shock | Stunned figure is left defenseless for numerous turns |
| Sunder | Cutting off another figure's head or arms | Sundered figure suffers bloodcount loss until the sundered limb or head can be replaced, also attack moves are limited until limbs are replaced |

An action figure 20 can avoid an attack 51 by an opposing action figure 20 by using his defenses 53, of strength, arcana, and dexterity. Each player's information card 50 will provide a specified number of rolls of a certain die for each characteristic. Since the attacks 51 each target a certain characteristic of an action figure 20, that action figure 20 can assert a corresponding defense 53 during the attack 51. For example, if a hold attack 51 targets an action figure's strength, that player will roll "3d10" to try to counter the attack 51 and prevent the hold. If the attacking player rolls more hits than the defending player is able to counter, the hold attack 51 becomes effective. Out-rolling an opponent is usually a defense 53 to an attack 51. This chart explains other various escape methods and defenses 53 a figure can use once attacked.

| Attack Move | Defensive Action or Escape Means |
|---|---|
| Fallen | Figure can move one section while getting up to prevent attack |
| Hold | If the figure being held, or the figure doing the holding is attacked the hold is broken |
| Thrashing | None, other than out rolling opponent |
| Throw | None, other than out rolling opponent |
| Blind | None, other than out rolling opponent |
| Burn | None, other than out rolling opponent |
| Immolate | Make your warrior fallen and lose a turn while extinguishing flames |
| Gusher | Out rolling your opponent during combat, or acquiring the missing body part from the game board |
| Disease | Disease is passed to another figure, cured, or leaves the figure's body |
| Impale | Referee will help impaled figure after three turns |
| Poison | No damage occurs if the figure refrains from action, moving doesn't cause damage, otherwise the poison wears off after a few turns |
| Stab | Figure can forfeit the attack turn and remove the weapon, requires figure to have at least one arm |
| Stun | Once the figure is attacked, successful or not, the Stun is lifted |
| Sunder | None, other than out rolling opponent |

Action figures 20 can acquire different types of weapons 61 during the game. Each time the weapons event occurs, a weapons card 60 will be placed on the game board by the location dice (FIGS. 4*c*, 4*e*). The weapons card 60 will include reach scores 62 while carrying the weapon 61, and attack moves 51 that can be performed while holding the weapon 61 and other information regarding the use of the weapon 61. When a player's action figure 20 lands on the same section 11 as the weapons card 60, that player can pick up the weapons card 60. When this occurs, the player will take the weapons card 60 from the game board 10 and find the corresponding weapon 61 in the game box and arm the action figure 20.

There are two types of weapons 61 used during play. The first type of weapon is known as a one-handed weapon. It can be used or picked up by an action figure 20 with at least one arm 31. The one-handed weapons can include knives, cleavers, light swords and other similar weapons. The second type of weapon is a two-handed weapon. It can only be picked up and used by action figures 20 with two arms 31 intact, although it may be carried by an action figure 20 that loses one arm 31 during combat whom had previous possession of the weapon. Two-handed weapons can include chainsaws, two-headed axes, nunchakus and other similar weapons. While carrying a weapons, an action figure's reach score 62 may be shortened, sometimes even shortened to "same". The weapons card 60 will also indicate how many hands are needed (see 64) to use the weapon 61.

Other miscellaneous activities that can occur during play include trap interaction and dead action figure 20 interaction. Trap interaction can allow players to spend an action obtaining a random spell or disposing of a sundered limb. This activity may also include a weapons rack, within the trap, that enables a player to draw a weapons card 60 as their action figure's 20 turn. Action figures 20 that lose all their bloodcount points are dead and remain on the game board 10. Interaction with dead figures on the game board 10 can included sundering needed arms 31 or heads 32 and throwing the dead action figures at other action figures 20.

Figure 7:
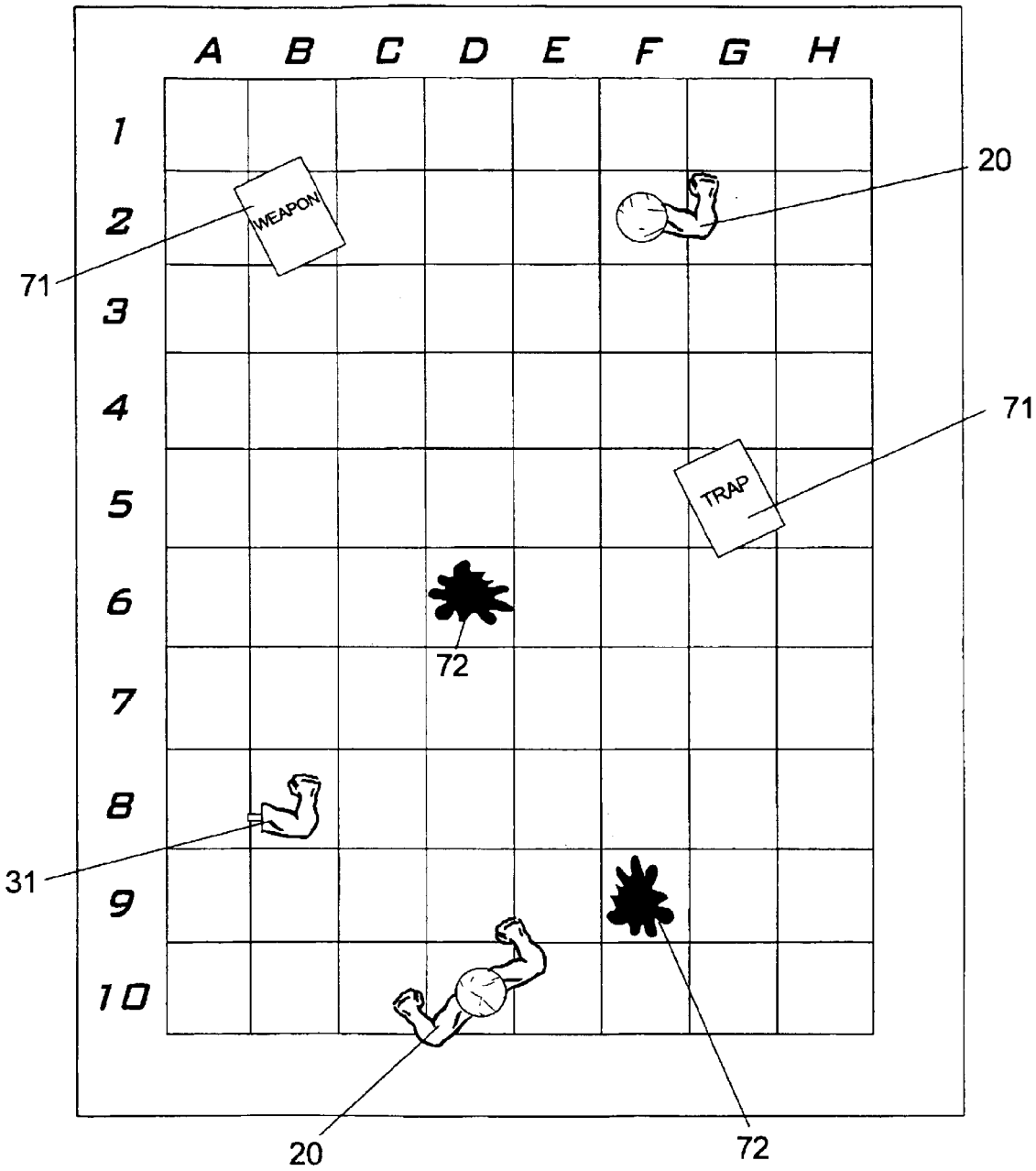
FIG. 7 is an overhead view of the game board with various game pieces shown.

Referring now to FIG. 7, a typical game board 10 is shown during play. Events cards 71 are placed upon the game board 10 using the location dice (FIGS. 4*e*, 4*c*). One of the action figures 20 is shown missing an arm 31, which is also placed upon the game board 10. Blood pools 72 are shown which represent 10 points of bloodcount, which can be picked up by the action figure 20 during play.

The combination role playing board game also includes a game handbook. This handbook provides users with the rules of the game and explains in detail the physical and mental abilities of each action figure 20. The handbook also describes multiple variations of the game that can be played. Further, events such as weapons, spells, traps, and diseases are thoroughly explained herein.

The first phase of the combination role playing board game is known as the event phase. To start the game, the first player rolls the event die (FIG. 4*f*). Then, the player draws a game card from the corresponding event category. The player then places the event card 71 upon the game board 10 using the location dice (FIGS. 4*e*, 4*c*). Next, the player hands the event die (FIG. 4*f*) to the player to the left and the game moves into phase two.

The second phase of the game is known as the attack and movement phase. Here each player is dealt two game card, known as action cards, numbered 1–20. The numbering on the cards represents when a player can act during this phase. The action cards can be either attack cards or movement cards. The players will act in numerical order according to the numbers on their action cards. Each player will be allowed two turns during this phase.

When acting on an attack card, a player has the option of attack, healing, casting a spell, or performing an evil deed, but cannot move his action figure 20. The movement cards can only be used for moving the action figure 20, never an attack. After each player has used his action and movement cards, the game progresses to phase three.

Phase three is known as the recovery and suffering phase. During the recovery phase, the player's action figure 20 can escape traps, fallen warriors can rise, absorb blood pools 72 to collect ten bloodpoints, pick up arms 31 or heads 32 severed from other action figures 20 from the game board 10. Next, the suffering phase occurs. Here, players roll for bloodpoint loss, according to the injuries from the attack and movement phase. After this phase, the player with the event die (FIG. 4*f*) rolls and the round begins again.

The method for playing the combination role playing and board game particularly includes the steps of receiving an action figure and an action figure information card, wherein the action figure is configured with detachable arm and head members. Placing one or more event cards on a grid-like game board. Rolling various game dice to simulate combat and movement of the various action figures on the grid-like game board. Indicating the health of the action figures where the health varies as a result of combat and is indicated by bloodcount points on the action figure information cards. Health can also be indicated by a loss of one or more arms and/or a head member, physically shown on the action figure.

The foregoing descriptions of the preferred embodiments of the invention have been presented for purposes of illustration and description. It is not intended to be exhausted or to limit the invention to the precise form disclosed, and obviously many modifications and variations are possible in like of the above teachings. Such modifications are variations that maybe apparent to a person skilled in the art are intended to be included within the scope of this invention as defined by the accompanying claims.

I claim:

1. A combination role playing and dice throwing board game, comprising:

a planar, grid-like game board including a plurality of sections;

two or more action figures, wherein said action figures are configured with two detachable arm members and a detachable head member;

wherein said two detachable arm members each further comprise rod members integrally attached to an extending outwardly therefrom;

a plurality of dice;

two or more action figure information cards, wherein said action figure information cards include a plurality of abilities of said action figures, and wherein said action figure information cards include bloodcount point charts; and, two or more tokens, whereby said tokens are placed upon said bloodcount point charts to track health of said action figures.

2. The combination role playing and dice throwing board game of claim 1, wherein said detachable head member further comprises rod members integrally attached to and extending outwardly therefrom.

3. The combination role playing and dice throwing board game of claim 1, wherein said game board is rectangular.

4. The combination role playing and dice throwing board game of claim 1, wherein said dice have a number of sides selected from the group consisting of six, eight, ten, and twelve.

5. The combination role playing and dice throwing board game of claim 1, wherein said action figure information cards include indicia for multiple attack and defense moves by each said action figure.

6. The combination role playing and dice throwing board game of claim 1, wherein one of said dice includes event information.

7. The combination role playing and dice throwing board game of claim 6, further comprising a plurality of game cards, wherein some of said game cards include said event information corresponding to one of said dice.

8. A combination role playing and dice throwing board game comprising:

two or more action figures, wherein said action figures are configured with two detachable arm and head members;

a plurality of dice;

one or more blood pool pieces, whereby said blood pool pieces are adapted for placement on a game board;

two or more action figure information cards, wherein said action figure information cards include a plurality of abilities of said action figures; and, a plurality of game cards, wherein some of said game cards include event information, said event information selected from the group consisting of weapon, spell, disease, and trap.

9. The combination role playing and dice throwing board game of claim 8, wherein said action figures further comprise rod members integrally attached to and extending outwardly from said detachable arm and head members of said action figures.

10. The combination role playing and dice throwing board game of claim 8, further comprising a planar, grid-like game board including a plurality of congruent sections, wherein said game board is rectangular.

11. The combination role playing and dice throwing board game of claim 8, wherein said dice have a number of sides selected from the group consisting of six, eight, ten, and twelve.

12. The combination role playing and dice throwing board game of claim 8, wherein said action figure information cards include indicia for multiple attack and defense moves by each said action figure.

13. The combination role playing and dice throwing board game of claim 8, wherein said action figure information cards include bloodcount point charts.

14. The combination role playing and dice throwing board game of claim 13, further comprising two or more tokens, whereby said tokens are placed upon said bloodcount point charts to track health of said action figure.

15. The combination role playing and dice throwing board game of claim 8, wherein one of said dice includes event information.

16. A method for playing a combination role playing and dice throwing board game, comprising the steps of:

receiving an action figure and an action figure information card, wherein said action figure is configured with two detachable arm and head members;

placing one or more event cards on a grid-like game board;

placing one or more event cards on a section of said grid-like game board;

rolling various game dice to simulate combat and movement of said action figure on said grid-like game board; and, visually indicating health of said action figure by such removel of said detachable arm members and said detachable head member as a result of said combat.

17. The method of claim 16, wherein said health is indicated by bloodcount points on said action figure information card.

* * * * *

UNITED STATES PATENT AND TRADEMARK OFFICE

CERTIFICATE OF CORRECTION

PATENT NO. : 6,938,898 B2
DATED : September 6, 2005
INVENTOR(S) : Gilbert S. Merritt, III It is certified that error appears in the above-identified patent and that said Letters Patent is hereby corrected as shown below:

Column 10,
Line 40, change "to an extend-" to -- to and extend- --.

Column 11,
Lines 8-9, change "with two detachable arm and head members;" to -- with two detachable arm members and a detachable head member; --.
Lines 24-25, change "from said detachable arm and head members of said action figures" to -- from said detachable arm members and said detachable head member of said action figure --.

Column 12,
Lines 17-18, change "with two detachable arm and head members;" to -- with two detachable arm members and a detachable head member; --.

Signed and Sealed this

Twenty-ninth Day of November, 2005

JON W. DUDAS
*Director of the United States Patent and Trademark Office*